US009731406B1

(12) United States Patent
Chen

(10) Patent No.: US 9,731,406 B1
(45) Date of Patent: Aug. 15, 2017

(54) SOCKET ASSEMBLY

(71) Applicant: PLUS CRAFT INDUSTRIAL CO., LTD., Taichung (TW)

(72) Inventor: Timmy Chen, Taichung (TW)

(73) Assignee: Plus Craft Industrial Co., Ltd., Taichung (TW)

( * ) Notice: Subject to any disclaimer, the term of this patent is extended or adjusted under 35 U.S.C. 154(b) by 17 days.

(21) Appl. No.: 15/045,347

(22) Filed: Feb. 17, 2016

(51) Int. Cl.
*B25B 13/10* (2006.01)
*B25B 13/00* (2006.01)
*B25B 13/04* (2006.01)

(52) U.S. Cl.
CPC ..... *B25B 13/102* (2013.01); *B25B 13/005* (2013.01); *B25B 13/04* (2013.01)

(58) Field of Classification Search
CPC ..... B25B 13/005; B25B 13/102; B25B 13/06; B25B 13/04; B25B 13/56
USPC ..... 81/121.1–124.5, 436–438
See application file for complete search history.

(56) References Cited

U.S. PATENT DOCUMENTS 2,697,958 A * 12/1954 Kozakewich ..... B25B 13/102 81/185
2,938,417 A * 5/1960 Haber ..... B25B 13/102 29/436
3,285,106 A * 11/1966 Svenson ..... B25B 13/102 81/185
3,298,261 A * 1/1967 Lynn ..... B25B 13/102 81/185
4,328,720 A * 5/1982 Shiel ..... B25B 13/06 81/124.6
4,840,094 A * 6/1989 Macor ..... B25B 13/06 81/124.5
5,829,328 A * 11/1998 Chen ..... B25B 13/102 81/124.5
6,467,379 B1 * 10/2002 Wizman ..... B25B 13/102 81/124.5
6,637,298 B1 * 10/2003 O'Brien ..... B25B 13/102 81/124.5

* cited by examiner

*Primary Examiner* — Larry E Waggle, Jr.
*Assistant Examiner* — Danny Hong
(74) *Attorney, Agent, or Firm* — Alan D. Kamrath; Kamrath IP Lawfirm, P.A.

(57) ABSTRACT

A socket assembly includes an outer socket, an inner socket mounted in the outer socket, and an intermediate socket mounted in the outer socket. The outer socket has a plurality of drive blocks and a plurality of retaining grooves. The inner socket includes a first base, a plurality of first driving sections, and a plurality of first openings. The intermediate socket includes a second base, a plurality of second driving sections, and a plurality of second openings. Thus, the inner diameter defined between the first driving sections is smaller than that defined between the second driving sections by 2 mm, and the inner diameter defined between the second driving sections is smaller than that defined between the drive blocks by 2 mm, so that the inner socket, the intermediate socket and the outer socket co-operate to operate three successive sizes of nuts.

8 Claims, 18 Drawing Sheets

SOCKET ASSEMBLY

BACKGROUND OF THE INVENTION

1. Field of the Invention

The present invention relates to a hand tool and, more particularly, to a socket assembly for operating nuts of three different sizes.

2. Description of the Related Art

A nut has successive sizes of 9 mm, 11 mm, 13 mm, 15 mm, 17 mm, 19 mm, 21 mm, 23 mm and the like. A conventional socket assembly in accordance with the prior art shown in FIGS. 16-19 is used to operate the nut and comprises an outer socket 6, an intermediate socket 7 and an inner socket 8. The outer socket 6 has a first end provided with a tool connector 61 and a second end provided with a workpiece connector 62. The workpiece connector 62 has an interior provided with a receiving chamber 63. The receiving chamber 63 has a periphery provided with a first inner ratchet portion 64. The outer socket 6 has a periphery provided with a screw bore 65 connected to the receiving chamber 63. The intermediate socket 7 has an outer wall provided with a first outer ratchet portion 71 engaging the first inner ratchet portion 64 of the outer socket 6 and an inner wall provided with a second inner ratchet portion 72. The intermediate socket 7 has a periphery provided with an elongate slot 73 having a front end 731 and a rear end 732. A first elastic member 74 is mounted in the receiving chamber 63 of the outer socket 6 and biased between the intermediate socket 7 and the outer socket 6. The inner socket 8 has an outer wall provided with a second outer ratchet portion 81 engaging the second inner ratchet portion 72 of the intermediate socket 7 and an inner wall provided with a third inner ratchet portion 82. The inner socket 8 has a periphery provided with a through hole 83. A second elastic member 85 is mounted in the receiving chamber 63 of the outer socket 6 and biased between the inner socket 8 and the outer socket 6. A first limit member 75 is screwed through the screw bore 65 of the outer socket 6 and received in the rear end 732 of the elongate slot 73. A second limit member 84 extends through the through hole 83 of the inner socket 8 and is received in the front end 731 of the elongate slot 73.

In operation, referring to FIG. 20 with reference to FIGS. 16-19, the conventional socket assembly is used to mount and operate a nut 9 with a smaller size which is smaller than that of the third inner ratchet portion 82 of the inner socket 8. The tool connector 61 is driven by a motorized or hand tool. The third inner ratchet portion 82 of the inner socket 8 engages the nut 9, the second outer ratchet portion 81 of the inner socket 8 engages the second inner ratchet portion 72 of the intermediate socket 7, and the first outer ratchet portion 71 of the intermediate socket 7 engages the first inner ratchet portion 64 of the outer socket 6, so that when the outer socket 6 is rotated, the intermediate socket 7 is rotated to drive the inner socket 8 which is rotated to drive the nut 9 so as to lock or unlock the nut 9.

Referring to FIG. 21 with reference to FIGS. 16-19, the conventional socket assembly is used to mount and operate a nut 91 with a mediate size which is greater than that of the third inner ratchet portion 82 of the inner socket 8. When the nut 91 is inserted into the intermediate socket 7, the inner socket 8 is pushed by the nut 91 toward the receiving chamber 63 of the outer socket 6. At this time, the second limit member 84 is moved in the elongate slot 73. The second inner ratchet portion 72 of the intermediate socket 7 engages the nut 91, and the first outer ratchet portion 71 of the intermediate socket 7 engages the first inner ratchet portion 64 of the outer socket 6, so that when the outer socket 6 is rotated, the intermediate socket 7 is rotated to drive the nut 91 so as to lock or unlock the nut 91. When the nut 91 is removed from the intermediate socket 7, the inner socket 8 is pushed outward by the second elastic member 85, and the second limit member 84 is moved in the elongate slot 73 to abut the front end 731 of the elongate slot 73.

Referring to FIG. 22 with reference to FIGS. 16-19, the conventional socket assembly is used to mount and operate a nut 92 with a larger size which is greater than that of the second inner ratchet portion 72 of the intermediate socket 7. When the nut 92 is inserted into the outer socket 6, the intermediate socket 7 is pushed by the nut 92 toward the receiving chamber 63 of the outer socket 6. At this time, the first limit member 75 is limited in the elongate slot 73. The first inner ratchet portion 64 of the outer socket 6 engages the nut 92 so that the outer socket 6 is rotated to directly drive the nut 92 so as to lock or unlock the nut 92. When the nut 92 is removed from the outer socket 6, the intermediate socket 7 is pushed outward by the first elastic member 74, and the elongate slot 73 is moved on the first limit member 75 until the rear end 732 of the elongate slot 73 abuts the first limit member 75.

Therefore, the conventional socket assembly is used to operate nuts 9, 91 and 92 of three different sizes. However, the torque from the nut is entirely tolerated by the intermediate socket 7 and the outer socket 6, so that each of the intermediate socket 7 and the outer socket 6 needs to have a determined thickness which is greater than 1 mm, such that the inner diameter of each of the second inner ratchet portion 72 of the intermediate socket 7 and the first inner ratchet portion 64 of the outer socket 6 has to be shortened by more than 2 mm. Thus, the conventional socket assembly is only available for operating three discontinuous sizes of nuts 9, 91 and 92, such as 13 mm, 17 mm, and 21 mm, or 15 mm, 19 mm and 23 mm or the like, and cannot be used to operate three discontinuous sizes of nuts 9, 91 and 92, such as 17 mm, 19 mm and 21 mm, or 19 mm, 21 mm and 23 mm or the like, thereby limiting the versatility of the conventional socket assembly.

BRIEF SUMMARY OF THE INVENTION

The primary objective of the present invention is to provide a socket assembly that is available for operating three successive sizes of nuts.

In accordance with the present invention, there is provided a socket assembly comprising an outer socket, an inner socket mounted in the outer socket, and an intermediate socket mounted in the outer socket. The outer socket has a first end provided with a tool connector and a second end provided with a workpiece connector. The workpiece connector has an interior provided with a receiving chamber. The receiving chamber has a periphery provided with a plurality of drive blocks and a plurality of retaining grooves arranged between the drive blocks. The inner socket is mounted in the receiving chamber of the outer socket and includes a first base, a plurality of first driving sections provided on the first base, and a plurality of first openings defined between the first driving sections. A first elastic member is mounted in the receiving chamber of the outer socket and is biased between the first base and the outer socket. The first base is formed with a first shaft hole. Each of the first driving sections has a face provided with a mounting recess mounted on one of the drive blocks of the outer socket. The intermediate socket is mounted in the receiving chamber of the outer socket and includes a second base, a plurality of second driving sections provided on the second base, and a plurality of second openings defined between the second driving sections. The second base of the intermediate socket abuts the first base of the inner socket. A second elastic member is mounted in the receiving chamber of the outer socket and is biased between the second base and the outer socket.

According to the primary advantage of the present invention, the inner diameter defined between the first driving sections is smaller than that defined between the second driving sections by 2 mm, and the inner diameter defined between the second driving sections is smaller than that defined between the drive blocks by 2 mm, so that the inner socket, the intermediate socket and the outer socket cooperate to operate three successive sizes of nuts, thereby enhancing the versatility of the socket assembly.

According to another advantage of the present invention, the mounting recess of each of the first driving sections is mounted on one of the drive blocks of the outer socket, the second driving sections of the intermediate socket are mounted in the retaining grooves of the outer socket, the second driving sections of the intermediate socket are received in the first openings of the inner socket, the first driving sections of the inner socket are received in the second openings of the intermediate socket, and the second tapered face of each of the second driving sections abuts the respective first tapered face of one of the first driving sections, so that the inner socket, the intermediate socket and the outer socket engage each other and have a great strength so as to withstand a large torque.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
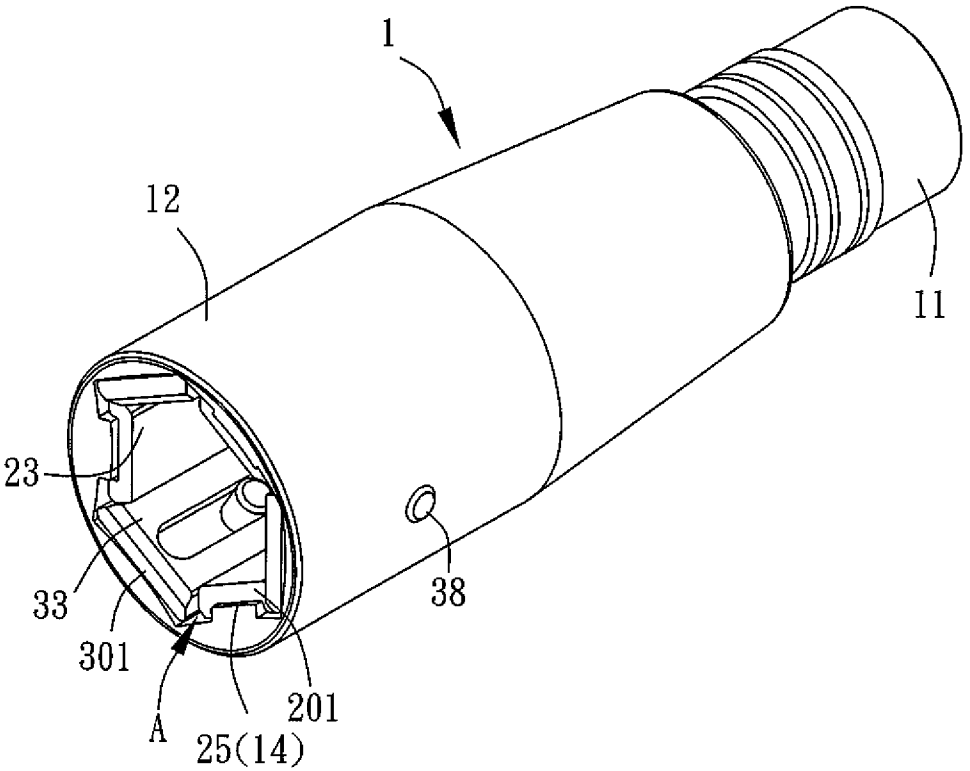
FIG. 1 is a perspective view of a socket assembly in accordance with the preferred embodiment of the present invention.
Figure 2:
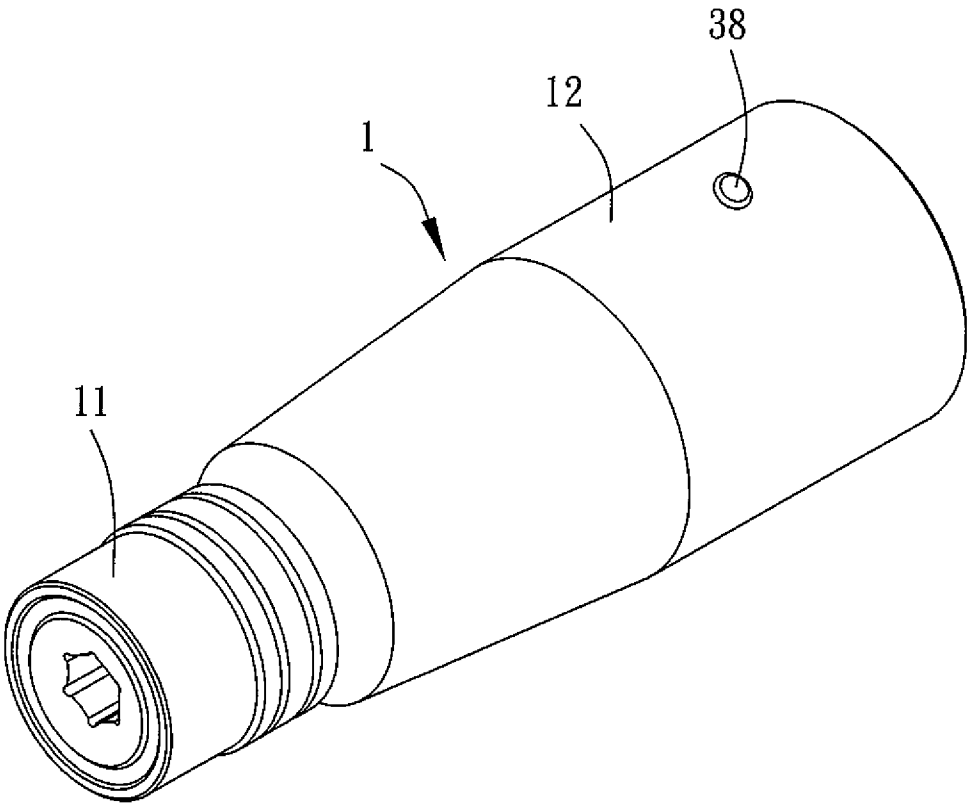
FIG. 2 is another perspective view of the socket assembly as shown in FIG. 1.
Figure 3:
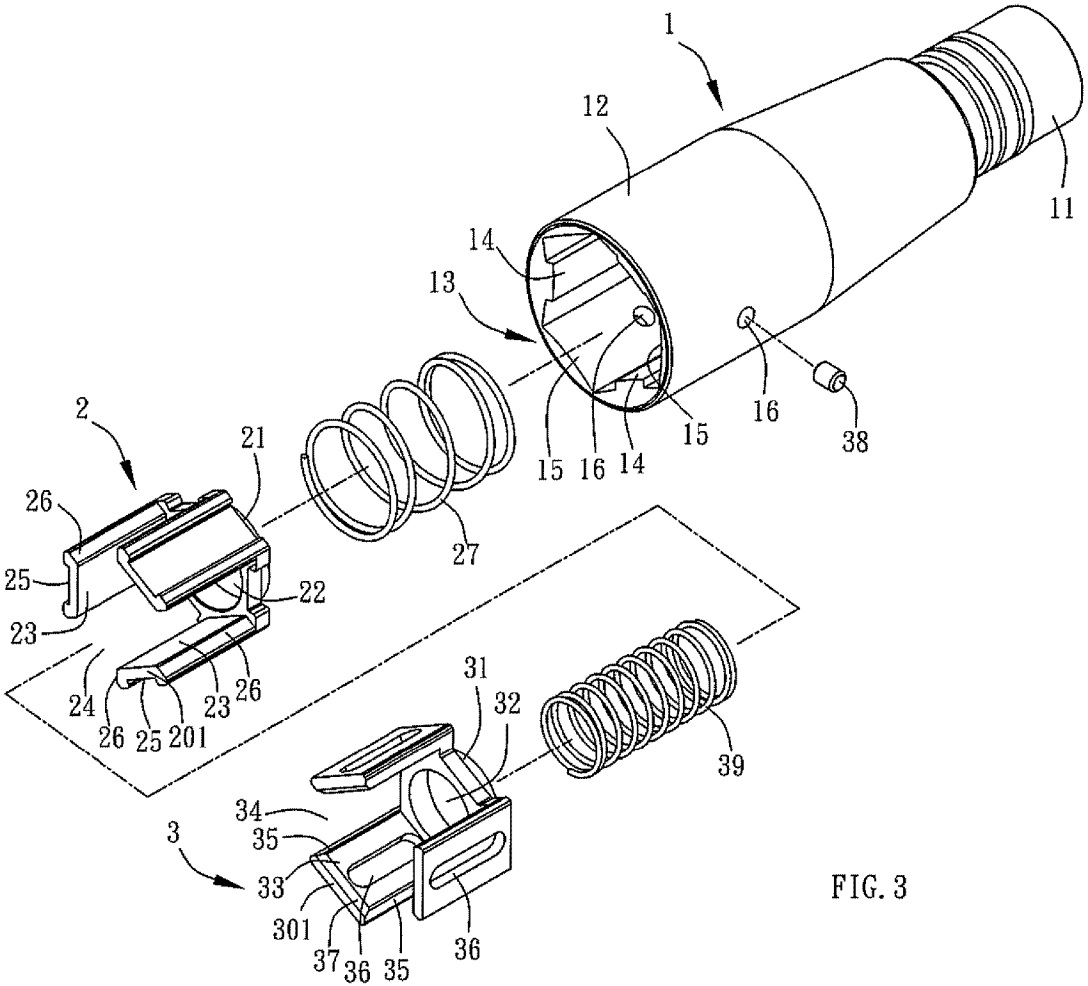
FIG. 3 is an exploded perspective view of the socket assembly as shown in FIG. 1.
Figure 4:
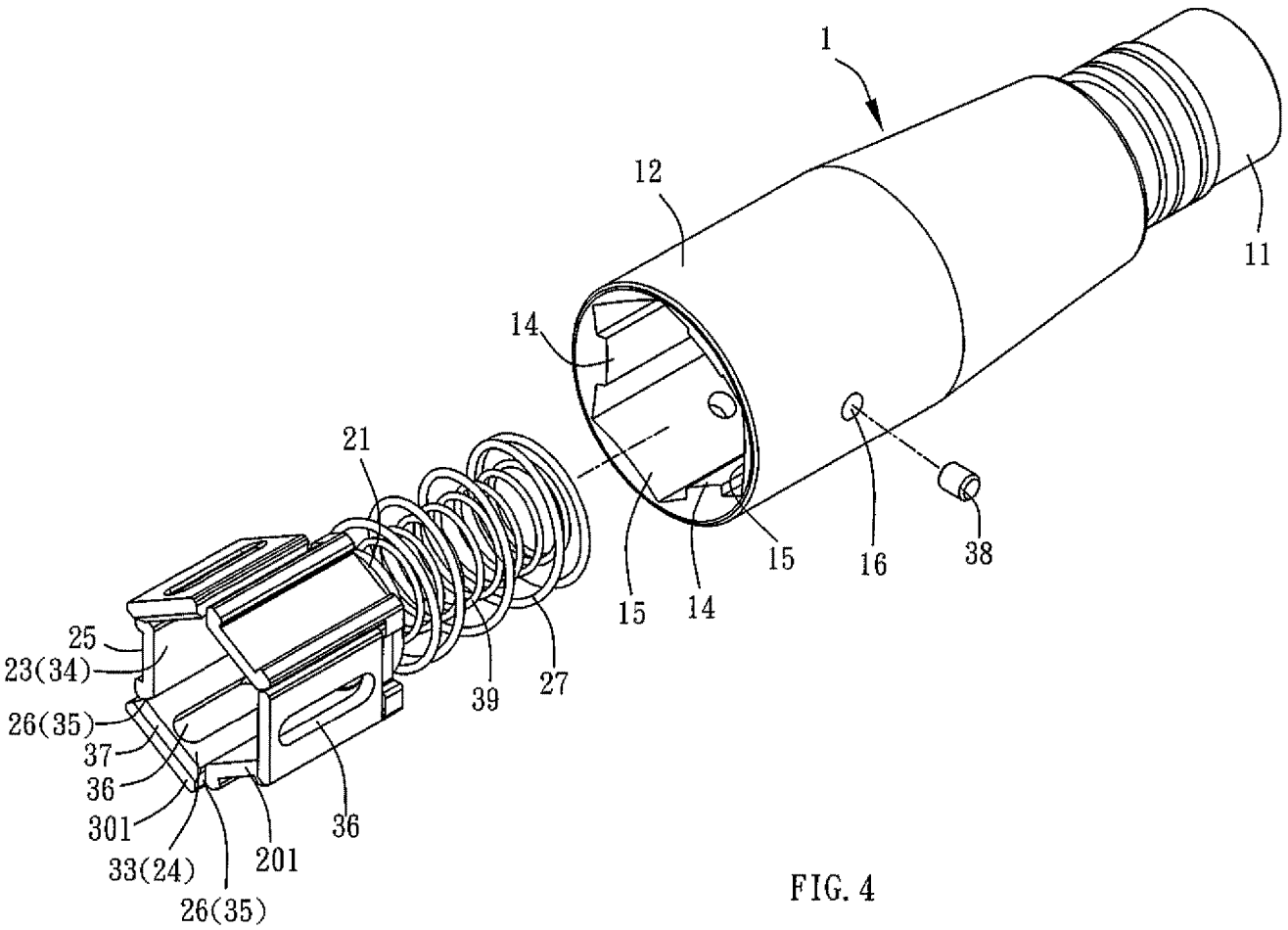
FIG. 4 is a partially exploded perspective view of the socket assembly as shown in FIG. 1.
Figure 5:
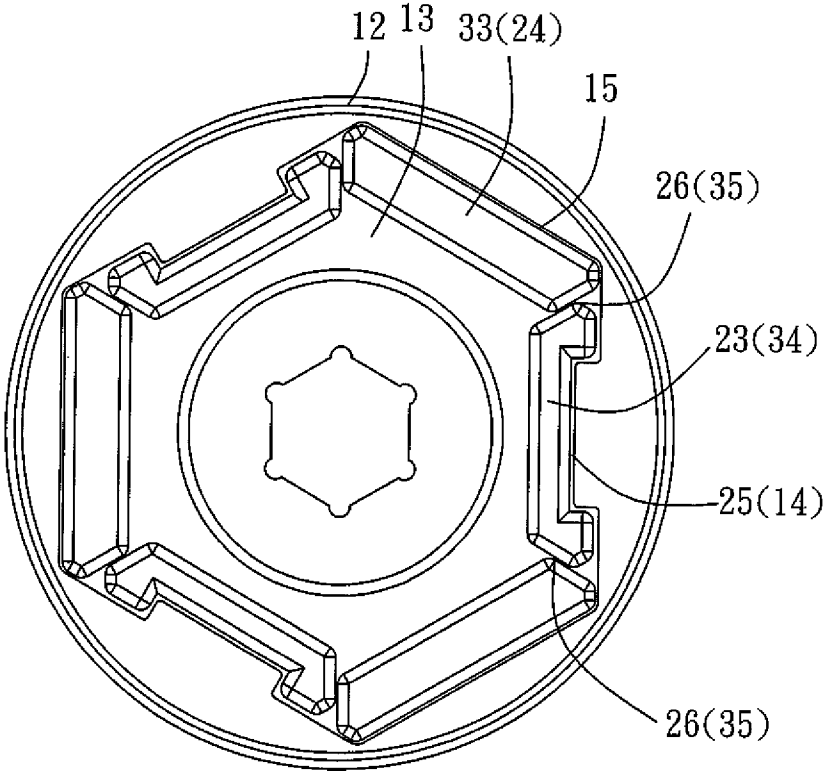
FIG. 5 is a front view of the socket assembly as shown in FIG. 1.
Figure 6:
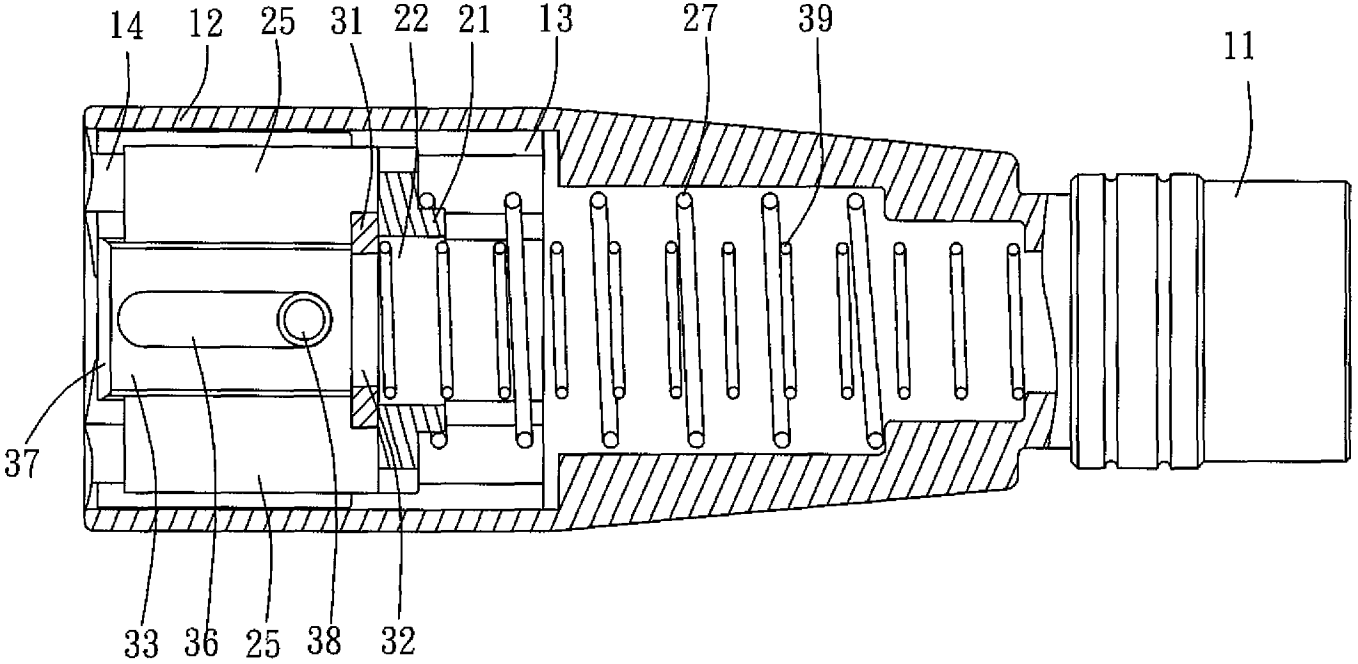
FIG. 6 is a side cross-sectional view of the socket assembly as shown in FIG. 1.
Figure 8:
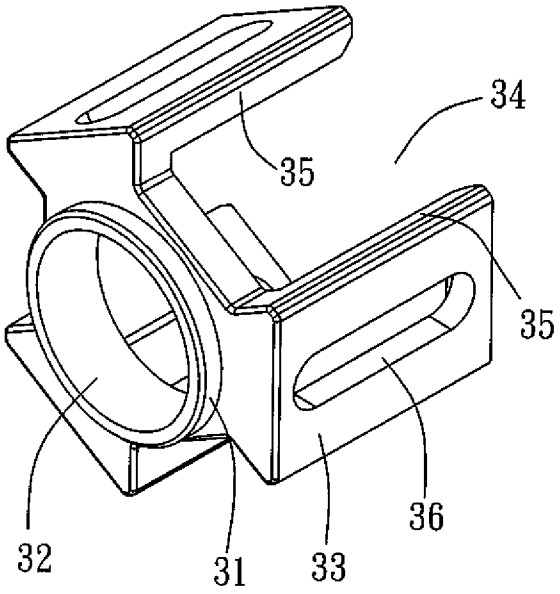
FIG. 8 is a perspective view of an intermediate socket of the socket assembly in accordance with the preferred embodiment of the present invention.
Figure 7:
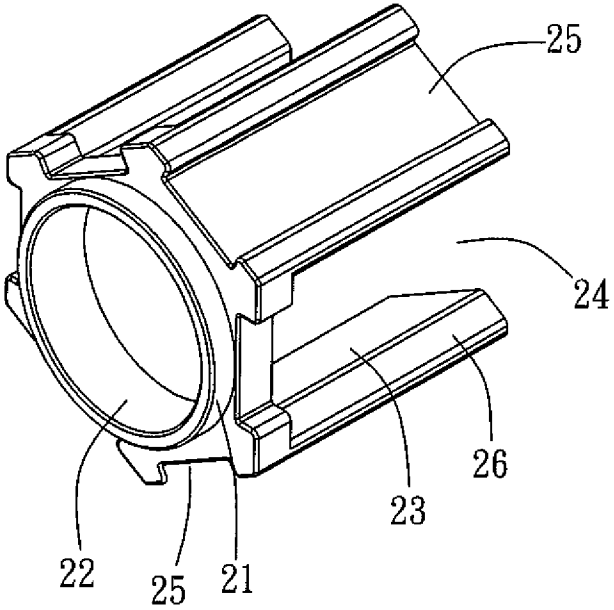
FIG. 7 is a perspective view of an inner socket of the socket assembly in accordance with the preferred embodiment of the present invention.
Figure 9:
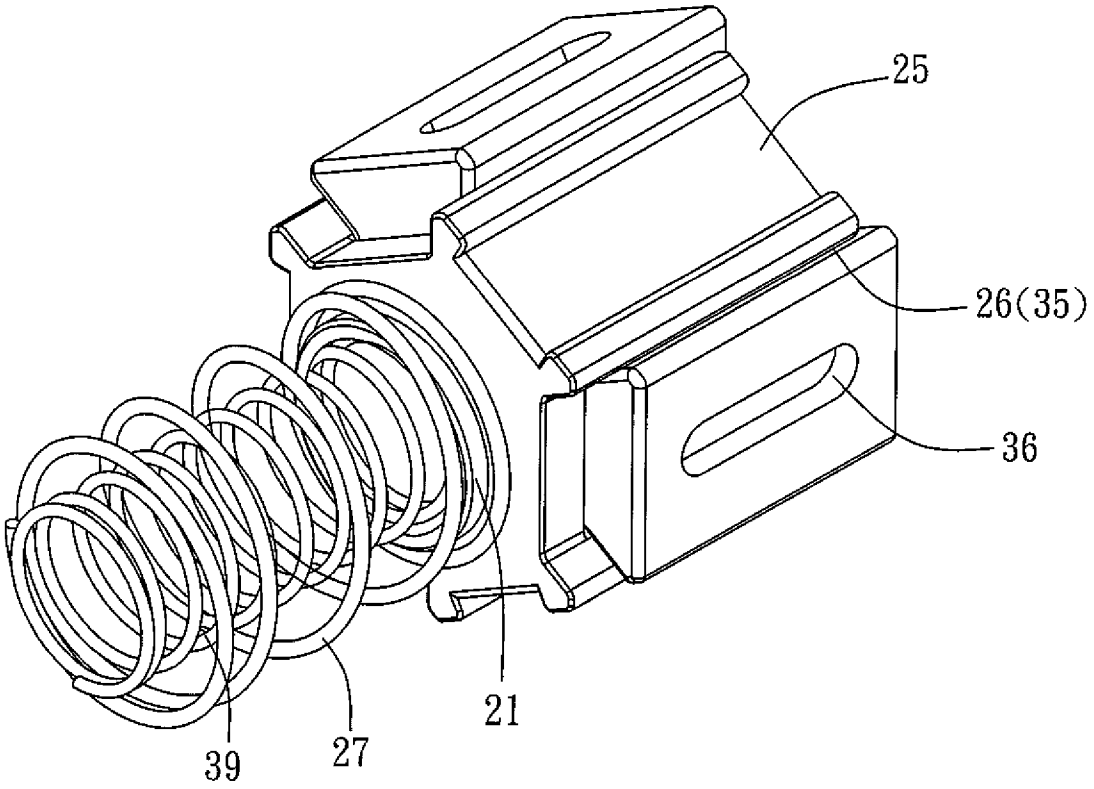
FIG. 9 is a partially perspective view of the socket assembly in accordance with the preferred embodiment of the present invention.
Figure 10:
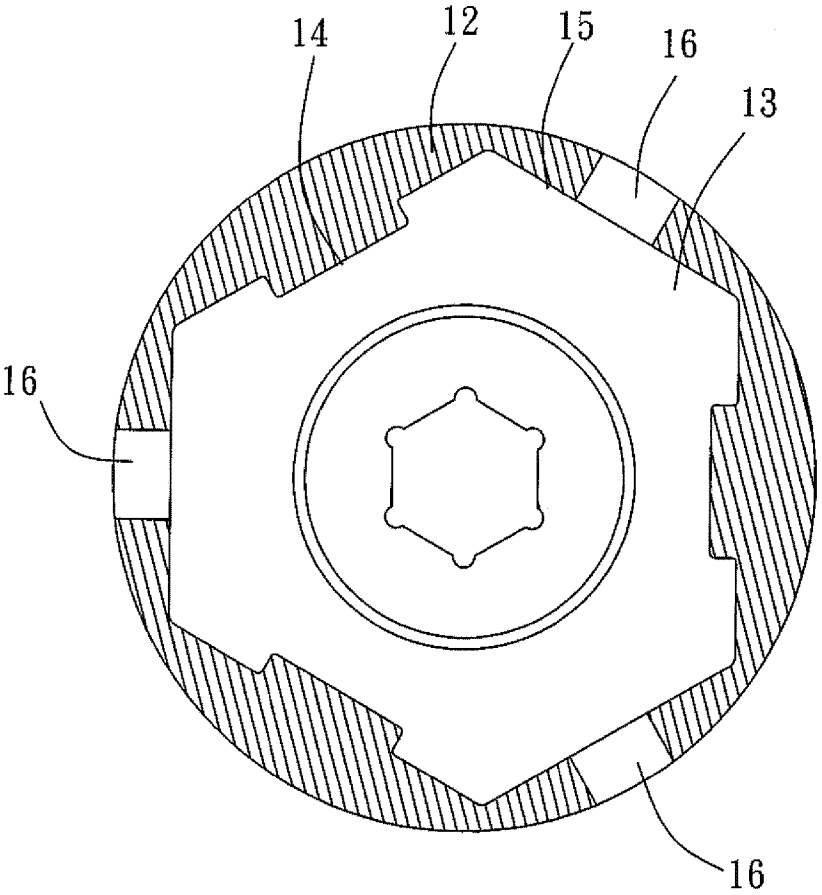
FIG. 10 is a front cross-sectional view of an outer socket of the socket assembly in accordance with the preferred embodiment of the present invention.

Referring to the drawings and initially to FIGS. 1-10, a socket assembly in accordance with the preferred embodiment of the present invention comprises an outer socket 1, an inner socket 2 mounted in the outer socket 1, and an intermediate socket 3 mounted in the outer socket 1.

The outer socket 1 has a first end provided with a tool connector 11 and a second end provided with a workpiece connector 12. The workpiece connector 12 has an interior provided with a receiving chamber 13. The receiving chamber 13 has a periphery provided with a plurality of drive blocks 14 and a plurality of retaining grooves 15 arranged between the drive blocks 14. The drive blocks 14 and the retaining grooves 15 are arranged successively in an annular manner and are adjacent to each other.

The inner socket 2 is mounted in the receiving chamber 13 of the outer socket 1 and includes a first base 21, a plurality of first driving sections 23 provided on the first base 21, and a plurality of first openings 24 defined between the first driving sections 23. A first elastic member 27 is mounted in the receiving chamber 13 of the outer socket 1 and is biased between the first base 21 and the outer socket 1. The first base 21 is formed with a first shaft hole 22. The first driving sections 23 are arranged in an annular manner. Each of the first driving sections 23 has a face provided with a mounting recess 25 mounted on one of the drive blocks 14 of the outer socket 1. The mounting recess 25 of each of the first driving sections 23 is slidable on one of the drive blocks 14 of the outer socket 1.

The intermediate socket 3 is mounted in the receiving chamber 13 of the outer socket 1 and includes a second base 31, a plurality of second driving sections 33 provided on the second base 31, and a plurality of second openings 34 defined between the second driving sections 33. The second base 31 of the intermediate socket 3 abuts the first base 21 of the inner socket 2. The second base 31 is formed with a second shaft hole 32. A second elastic member 39 is mounted in the receiving chamber 13 of the outer socket 1 and is biased between the second base 31 and the outer socket 1. The second elastic member 39 extends through the first shaft hole 22 of the first base 21 and is received in the first elastic member 27. The second driving sections 33 are mounted in the retaining grooves 15 of the outer socket 1 and are arranged in an annular manner. The second driving sections 33 of the intermediate socket 3 are received in the first openings 24 of the inner socket 2, and the first driving sections 23 of the inner socket 2 are received in the second openings 34 of the intermediate socket 3.

In the preferred embodiment of the present invention, each of the second driving sections 33 is provided with a guide slot 36, the outer socket 1 has a periphery provided with a plurality of through holes 16 connected to the receiving chamber 13, and a plurality of limit members 38 extend through the through holes 16 of the outer socket 1 into the receiving chamber 13. Each of the limit members 38 is received and limited in the guide slot 36 of one of the second driving sections 33. Thus, the intermediate socket 3 is movable in the receiving chamber 13 of the outer socket 1 and limited by the limit members 38.

In the preferred embodiment of the present invention, the outer socket 1 has three drive blocks 14 and three retaining grooves 15, and the drive blocks 14 and the retaining grooves 15 are arranged successively to form an inner diameter of the receiving chamber 13. In addition, the outer socket 1 has three through holes 16. The inner socket 2 includes three first driving sections 23 and three first openings 24. The intermediate socket 3 includes three second driving sections 33 and three second openings 34.

In the preferred embodiment of the present invention, each of the first driving sections 23 has two sides each provided with a first tapered face 26, and each of the second driving sections 33 has two sides each provided with a second tapered face 35 abutting the respective first tapered face 26 of one of the first driving sections 23. In addition, each of the second driving sections 33 has a front end provided with a chamfered portion 37.

In the preferred embodiment of the present invention, an inner diameter defined between the first driving sections 23 is smaller than that defined between the second driving sections 33 by 2 mm, and an inner diameter defined between the second driving sections 33 is smaller than that defined between the drive blocks 14 by 2 mm.

In the preferred embodiment of the present invention, a front end 201 of the inner socket 2 is extended deeper into the receiving chamber 13 than a front end 301 of the intermediate socket 3, with a position difference "A" being defined between the front end 201 of the inner socket 2 and the front end 301 of the intermediate socket 3.

Figure 11:
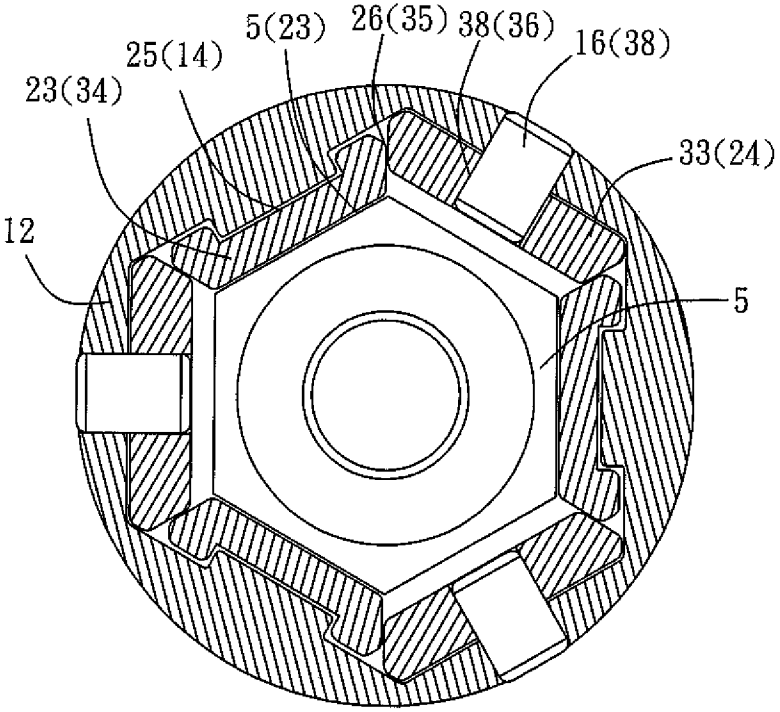
FIG. 11 is a schematic front cross-sectional operational view of the socket assembly as shown in FIG. 1.

In operation, referring to FIG. 11 with reference to FIGS. 1-10, the socket assembly is used to mount and operate a nut 5 with an outer diameter of 17 mm. At this time, the position difference "A" is defined between the front end 201 of the inner socket 2 and the front end 301 of the intermediate socket 3, so that when the nut 5 is inserted into the receiving chamber 13 of the outer socket 1, the nut 5 is introduced into the inner socket 2 quickly and exactly. When the nut 5 is received in the inner socket 2, the first driving sections 23 press the nut 5. At this time, the mounting recess 25 of each of the first driving sections 23 is mounted on one of the drive blocks 14 of the outer socket 1, the second driving sections 33 of the intermediate socket 3 are mounted in the retaining grooves 15 of the outer socket 1, so that when the outer socket 1 is rotated by a motorized or hand tool, the inner socket 2 and the intermediate socket 3 are rotated in concert with the outer socket 1, and the nut 5 is rotated by the first driving sections 23. When the outer socket 1 is rotated, the first driving sections 23 of the inner socket 2 are supported by the drive blocks 14 of the outer socket 1, and the second tapered face 35 of each of the second driving sections 33 abuts the respective first tapered face 26 of one of the first driving sections 23, so that the inner socket 2 has a great strength and can withstand a large torque so as to lock or unlock the nut 5.

Figure 12:
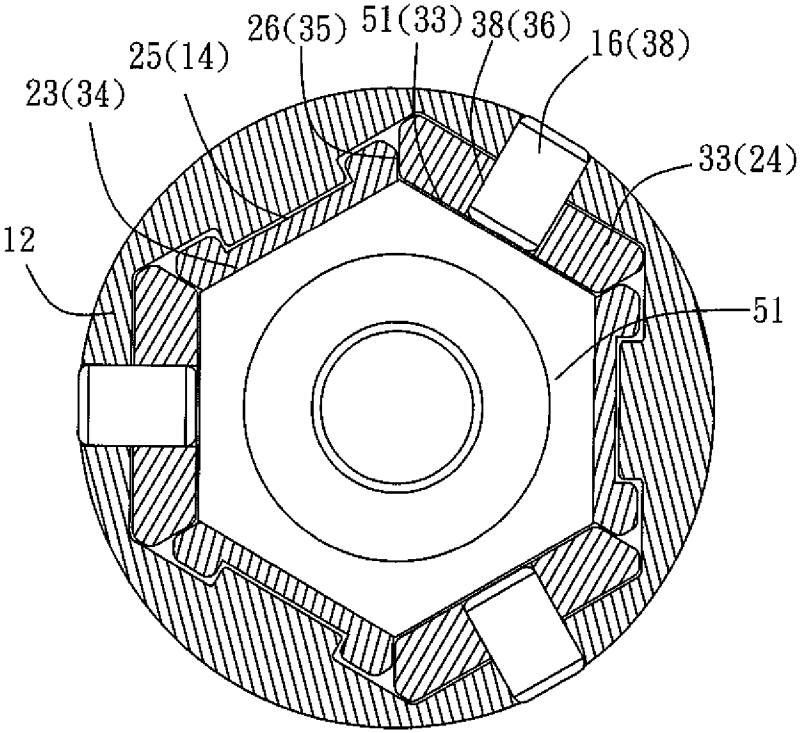
FIG. 12 is another schematic front cross-sectional operational view of the socket assembly as shown in FIG. 1.

Referring now to FIG. 12 with reference to FIGS. 1-10, the socket assembly is used to mount and operate a nut 51 with an outer diameter of 19 mm. When the nut 51 is inserted into the receiving chamber 13 of the outer socket 1, the nut 51 is introduced into the intermediate socket 3 quickly and exactly by guidance of the chamfered portion 37 of each of the second driving sections 33. At this time, the outer diameter of the nut 51 is greater than the inner diameter defined between the first driving sections 23, so that the nut 51 will push the first driving sections 23 of the inner socket 2 to retract into the receiving chamber 13 of the outer socket 1 and to compress the first elastic member 27. When the nut 51 is received in the intermediate socket 3, the second driving sections 33 press the nut 51. Thus, when the outer socket 1 is rotated, the intermediate socket 3 is rotated in concert with the outer socket 1, and the nut 51 is driven and rotated by the second driving sections 33 of the intermediate socket 3. At this time, when the outer socket 1 is rotated, the second driving sections 33 of the intermediate socket 3 are supported and limited by the retaining grooves 15 of the outer socket 1, and the second tapered face 35 of each of the second driving sections 33 abuts the respective first tapered face 26 of one of the first driving sections 23, so that the intermediate socket 3 has a great strength and can withstand a large torque so as to lock or unlock the nut 51.

Figure 13:
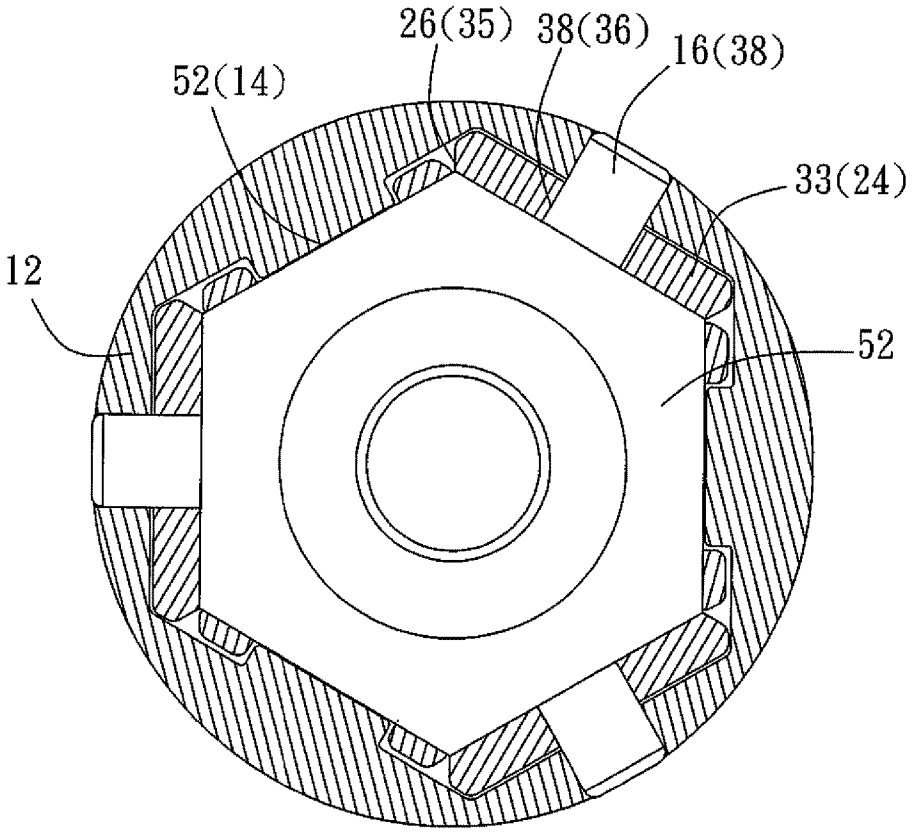
FIG. 13 is another schematic front cross-sectional operational view of the socket assembly as shown in FIG. 1.

Referring now to FIG. 13 with reference to FIGS. 1-10, the socket assembly is used to mount and operate a nut 52 with an outer diameter of 21 mm. At this time, the outer diameter of the nut 52 is greater than the inner diameter defined between the first driving sections 23 and the inner diameter defined between the second driving sections 33, so that when the nut 52 is inserted into the receiving chamber 13 of the outer socket 1, the nut 52 will push the first driving sections 23 of the inner socket 2 and the second driving sections 33 of the intermediate socket 3 to retract into the receiving chamber 13 of the outer socket 1 and to compress the first elastic member 27 and the second elastic member 39. In addition, each of the limit members 38 is received and limited in the guide slot 36 of one of the second driving sections 33 to limit movement of the intermediate socket 3. When the nut 52 is received in the outer socket 1, the drive blocks 14 of the outer socket 1 press the nut 52. Thus, when the outer socket 1 is rotated, the nut 52 is driven and rotated by the drive blocks 14 of the outer socket 1.

Accordingly, the inner diameter defined between the first driving sections 23 is smaller than that defined between the second driving sections 33 by 2 mm, and the inner diameter defined between the second driving sections 33 is smaller than that defined between the drive blocks 14 by 2 mm, so that the inner socket 2, the intermediate socket 3 and the outer socket 1 co-operate to operate three successive sizes (17 mm, 19 mm and 20 mm) of nuts 5, 51 and 52, thereby enhancing the versatility of the socket assembly. In addition, the mounting recess 25 of each of the first driving sections 23 is mounted on one of the drive blocks 14 of the outer socket 1, the second driving sections 33 of the intermediate socket 3 are mounted in the retaining grooves 15 of the outer socket 1, the second driving sections 33 of the intermediate socket 3 are received in the first openings 24 of the inner socket 2, the first driving sections 23 of the inner socket 2 are received in the second openings 34 of the intermediate socket 3, and the second tapered face 35 of each of the second driving sections 33 abuts the respective first tapered face 26 of one of the first driving sections 23, so that the inner socket 2, the intermediate socket 3 and the outer socket 1 engage each other and have a great strength so as to withstand a large torque.

Figure 14:
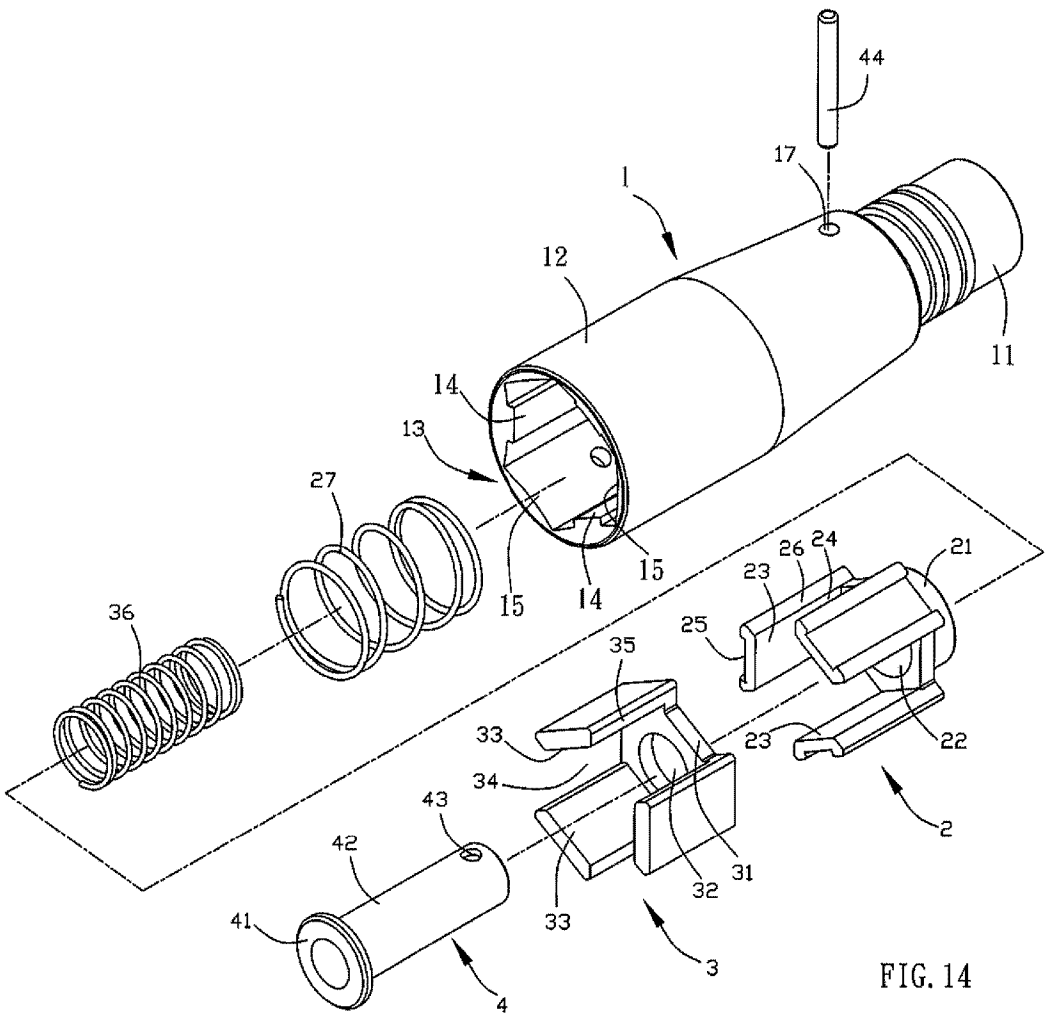
FIG. 14 is an exploded perspective view of a socket assembly in accordance with another preferred embodiment of the present invention.
Figure 15:
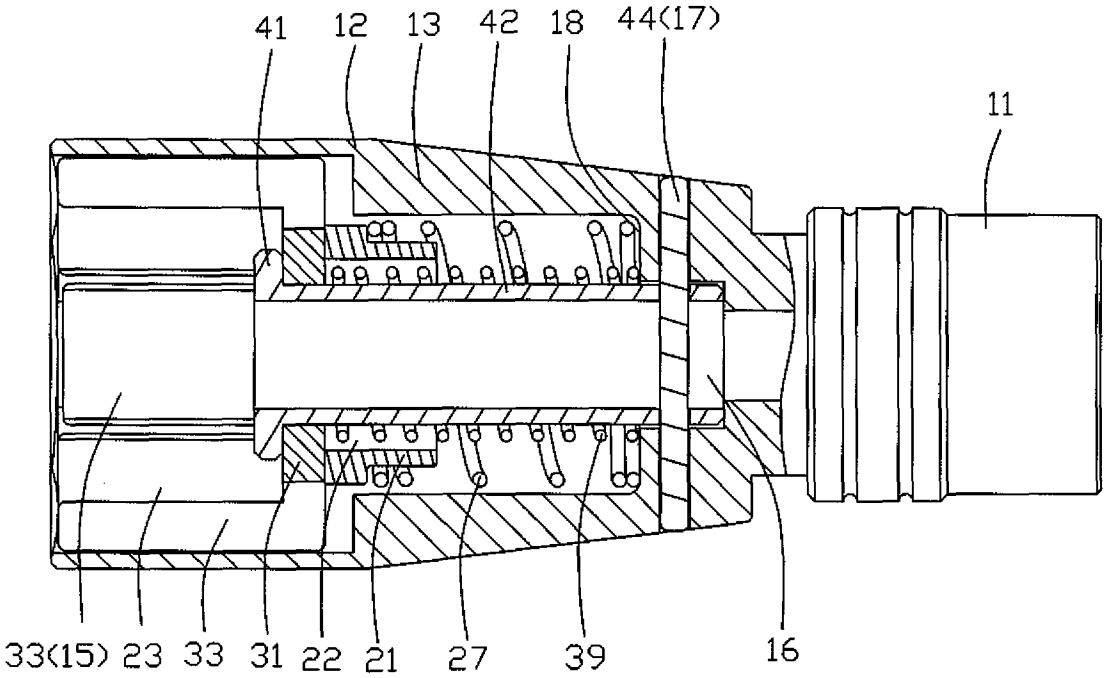
FIG. 15 is a side cross-sectional view of the socket assembly as shown in FIG. 14.
Figure 16:
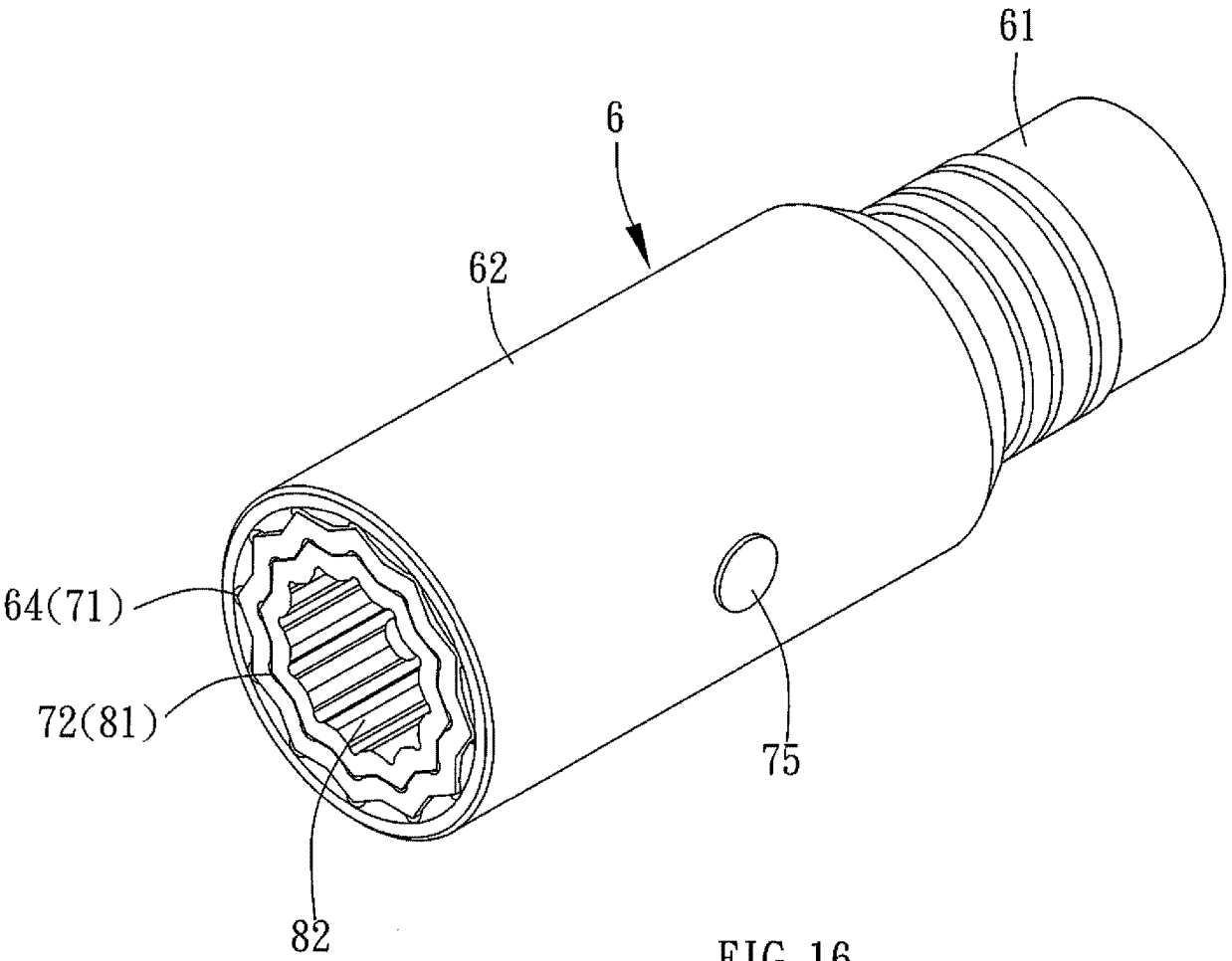
FIG. 16 PRIOR ART
FIG. 16 is a perspective view of a conventional socket assembly in accordance with the prior art.
Figure 17:
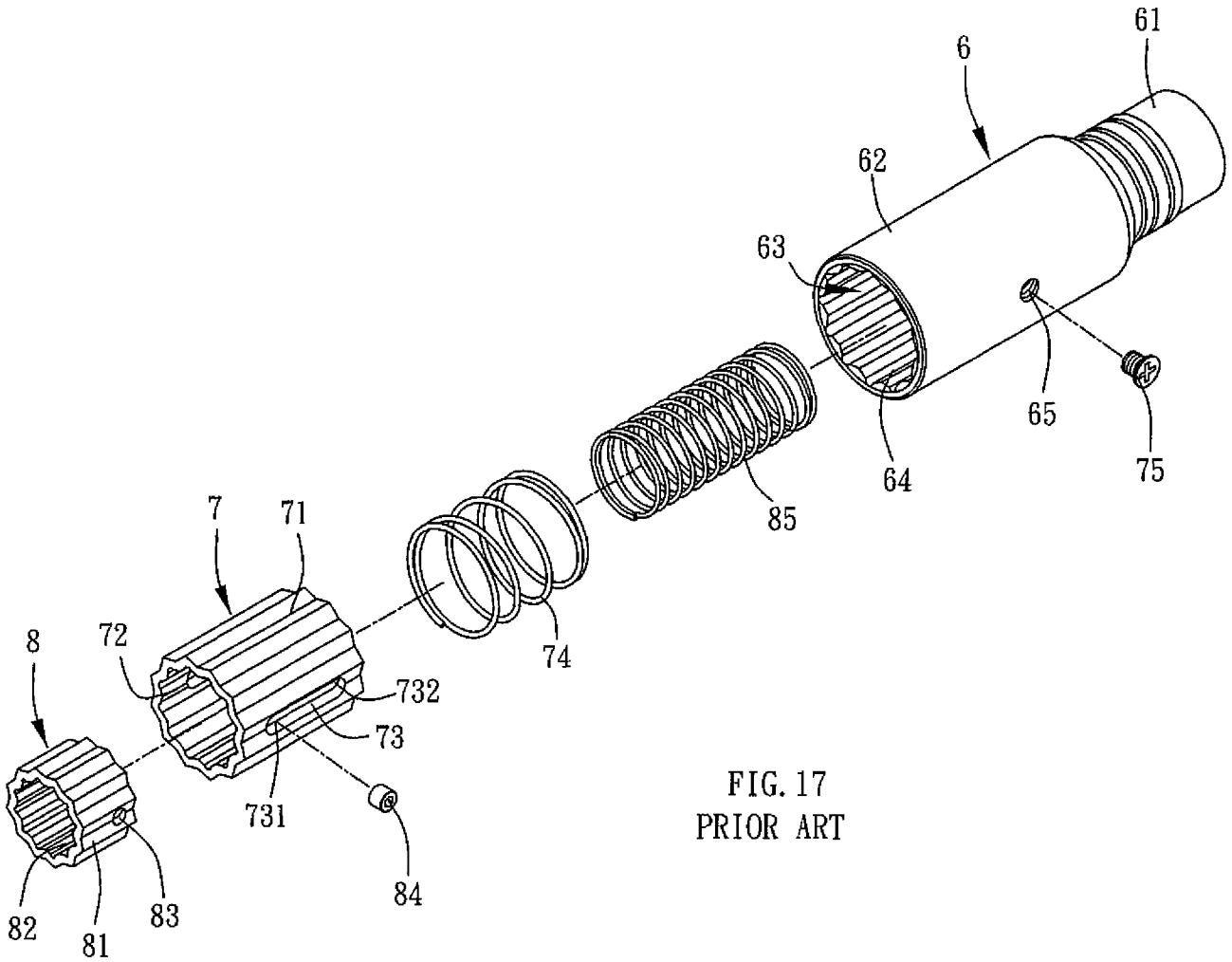
FIG. 17 PRIOR ART
FIG. 17 is an exploded perspective view of the conventional socket assembly as shown in FIG. 16.
Figure 18:
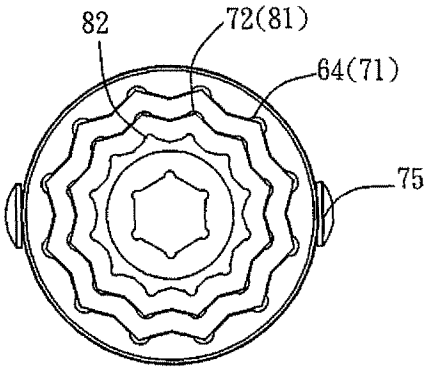
FIG. 18 PRIOR ART
FIG. 18 is a front view of the conventional socket assembly as shown in FIG. 16.
Figure 19:
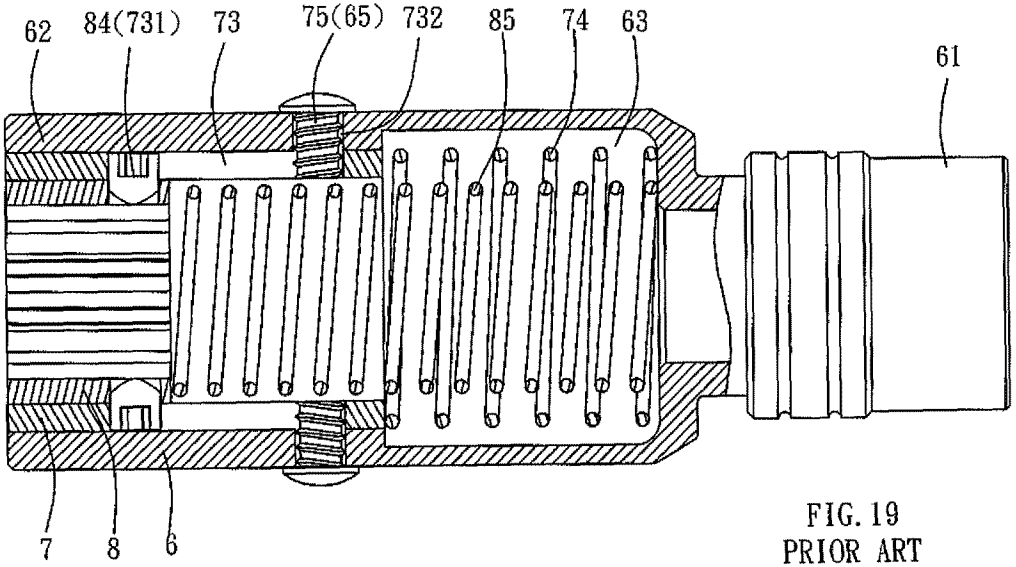
FIG. 19 PRIOR ART
FIG. 19 is a partially side cross-sectional view of the conventional socket assembly as shown in FIG. 16.
Figure 22:
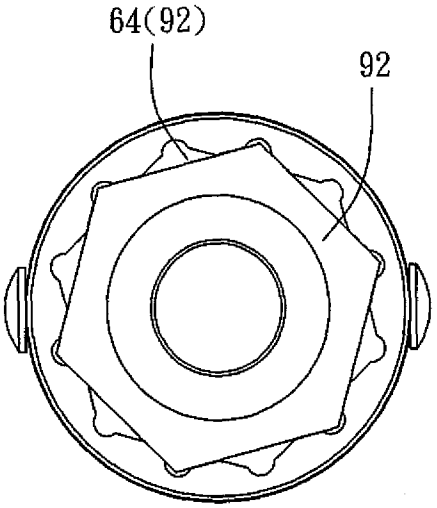
FIG. 22 PRIOR ART
FIG. 22 is another schematic operational view of the conventional socket assembly as shown in FIG. 18.
Figure 21:
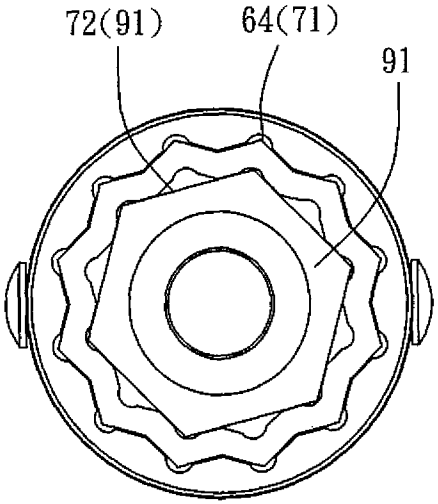
FIG. 21 PRIOR ART
FIG. 21 is another schematic operational view of the conventional socket assembly as shown in FIG. 18.
Figure 20:
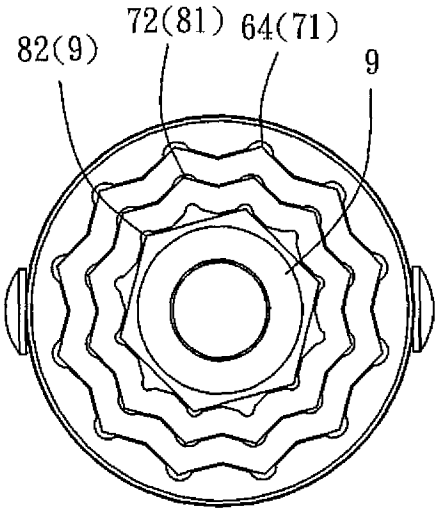
FIG. 20 PRIOR ART
FIG. 20 is a schematic operational view of the conventional socket assembly as shown in FIG. 18.

Referring to FIGS. 14 and 15, the socket assembly further comprises a shaft 4 extending through the intermediate socket 3 and the inner socket 2 and secured in the outer socket 1 to limit the intermediate socket 3 and the inner socket 2 in the outer socket 1. The shaft 4 is mounted in the receiving chamber 13 of the outer socket 1 includes a hollow shank 42 having a first end provided with a bore 43 and a head 41 formed on a second end of the shank 42. The shank 42 extends through the second shaft hole 32 of the intermediate socket 3 and the first shaft hole 22 of the inner socket 2. The head 41 has an outer diameter greater than an inner diameter of the second shaft hole 32 of the intermediate socket 3 and abuts the second base 31 of the intermediate socket 3 to limit the intermediate socket 3 and the inner socket 2 in the outer socket 1. The outer socket 1 has a periphery provided with an aperture 17 connected to the receiving chamber 13, and a mandrel 44 extends through the aperture 17 of the outer socket 1 and the bore 43 of the shaft 4 so that the shaft 4 is secured in the receiving chamber 13 of the outer socket 1. Thus, the second shaft hole 32 of the intermediate socket 3 and the first shaft hole 22 of the inner socket 2 are mounted on the shaft 4 so that the intermediate socket 3 and the inner socket 2 are movable on the shaft 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A socket assembly comprising: an outer socket; an inner socket mounted in the outer socket; and an intermediate socket mounted in the outer socket; wherein:

the outer socket has a first end provided with a tool connector and a second end provided with a workpiece connector; the workpiece connector has an interior provided with a receiving chamber; the receiving chamber has a periphery provided with a plurality of drive blocks and a plurality of retaining grooves arranged between the drive blocks; the inner socket is mounted in the receiving chamber of the outer socket and includes a first base, a plurality of first driving sections provided on the first base, and a plurality of first openings defined between the first driving sections; a first elastic member is mounted in the receiving chamber of the outer socket and is biased between the first base and the outer socket; the first base is formed with a first shaft hole; each of the first driving sections has a face provided with a mounting recess mounted on one of the drive blocks of the outer socket; the intermediate socket is mounted in the receiving chamber of the outer socket and includes a second base, a plurality of second driving sections provided on the second base, and a plurality of second openings defined between the second driving sections; the second base of the intermediate socket abuts the first base of the inner socket; and a second elastic member is mounted in the receiving chamber of the outer socket and is biased between the second base and the outer socket; wherein the socket assembly further comprises a shaft extending through the intermediate socket and the inner socket and secured in the outer socket to limit the intermediate socket and the inner socket in the outer socket; wherein the second base is formed with a second shaft hole, the shaft is mounted in the receiving chamber of the outer socket includes a hollow shank having a first end provided with a bore and a head formed on a second end of the shank, the shank extends through the second shaft hole of the intermediate socket and the first shaft hole of the inner socket, the head has an outer diameter greater than an inner diameter of the second shaft hole of the intermediate socket and abuts the second base of the intermediate socket to limit the intermediate socket and the inner socket in the outer socket, the outer socket has a periphery provided with an aperture connected to the receiving chamber, and a mandrel extends through the aperture of the outer socket and the bore of the shaft so that the shaft is secured in the receiving chamber of the outer socket.

2. The socket assembly of claim 1, wherein the outer socket has three drive blocks and three retaining grooves, and the drive blocks and the retaining grooves are arranged successively to form an inner diameter of the receiving chamber.

3. The socket assembly of claim 1, wherein each of the second driving sections is provided with a guide slot, the outer socket has a periphery provided with a plurality of through holes connected to the receiving chamber, and a plurality of limit members extend through the through holes of the outer socket into the receiving chamber wherein each of the limit members is received and limited in the guide slot of one of the second driving sections.

4. The socket assembly of claim 1, wherein each of the first driving sections has two sides each provided with a first tapered face, and each of the second driving sections has two sides each provided with a second tapered face abutting the respective first tapered face of one of the first driving sections.

5. The socket assembly of claim 1, wherein each of the second driving sections has a front end provided with a chamfered portion.

6. The socket assembly of claim 1, wherein the second driving sections of the intermediate socket are received in the first openings of the inner socket, and the first driving sections of the inner socket are received in the second openings of the intermediate socket.

7. The socket assembly of claim 1, wherein an inner diameter defined between the first driving sections is smaller than that defined between the second driving sections by 2 mm, and an inner diameter defined between the second driving sections is smaller than that defined between the drive blocks by 2 mm.

8. The socket assembly of claim 1, wherein a front end of the inner socket is extended deeper into the receiving chamber than a front end of the intermediate socket, with a position difference being defined between the front end of the inner socket and the front end of the intermediate socket.

* * * * *